US009304452B2

(12) United States Patent
Ohata

(10) Patent No.: US 9,304,452 B2
(45) Date of Patent: Apr. 5, 2016

(54) FIXING DEVICE AND IMAGE FORMING APPARATUS

(71) Applicant: KYOCERA Document Solutions Inc., Osaka (JP)

(72) Inventor: Shinobu Ohata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/592,214

(22) Filed: Jan. 8, 2015

(65) Prior Publication Data

US 2015/0205240 A1 Jul. 23, 2015

(30) Foreign Application Priority Data

Jan. 22, 2014 (JP) ..... 2014-009170

(51) Int. Cl.
*G03G 15/20* (2006.01)

(52) U.S. Cl.
CPC .... *G03G 15/2028* (2013.01); *G03G 2215/0132* (2013.01)

(58) Field of Classification Search
CPC ..... G03G 15/2085; G03G 2215/0132
USPC ..... 399/323
See application file for complete search history.

(56) References Cited

U.S. PATENT DOCUMENTS 5,548,389 A * 8/1996 Bowler, Jr. ..... 399/406
2011/0064441 A1* 3/2011 Morihara ..... 399/69

FOREIGN PATENT DOCUMENTS

JP 2012-226006 A 11/2012

* cited by examiner

*Primary Examiner* — David Bolduc
*Assistant Examiner* — Barnabas Fekete
(74) *Attorney, Agent, or Firm* — Studebaker & Brackett PC

(57) ABSTRACT

A fixing device includes a fixing member, a pressuring member, a separating member and a reciprocating mechanism. The fixing member is arranged rotatably around a rotation axis. The fixing member includes a passing region and a non-passing region. Through the passing region, a recording medium passes. The non-passing region is arranged outside the passing region. The pressuring member is arranged rotatably and configured to come into pressure contact with the fixing member so as to form a fixing nip. The separating member includes a separating plate and a contact piece. The separating plate is configured to face the passing region with an interval and separate the recording medium passing through the fixing nip from the passing region. The contact piece is configured to come into contact with the non-passing region. The reciprocating mechanism is configured to reciprocate the separating member along a direction of the rotation axis.

9 Claims, 10 Drawing Sheets

FIXING DEVICE AND IMAGE FORMING APPARATUS

INCORPORATION BY REFERENCE

This application is based on and claims the benefit of priority from Japanese Patent application No. 2014-009170 filed on Jan. 22, 2014, the entire contents of which are incorporated herein by reference.

BACKGROUND

The present disclosure relates to a fixing device fixing a toner image onto a recording medium and an image forming apparatus including the fixing device.

Conventionally, an electrographic image forming apparatus, such as a copying machine or a printer, includes a fixing device fixing a toner image onto a recording medium, such as a sheet or the like. The fixing device includes a fixing member (e.g. a fixing roller or a fixing belt) and a pressuring member (e.g. a pressuring roller or a pressuring belt) configured to come into pressure contact with the fixing member. The recording medium and the toner image are heated and pressed at a fixing nip formed between the fixing member and the pressuring member so that the toner image is fixed onto the recording medium.

For example, there is a fixing device including a fixing member, a pressuring member configured to come into pressure contact with the fixing member so as to form a fixing nip and a separating member configured to separate the recording medium passing through the fixing nip from the fixing member. The separating member includes a separating plate configured to face a passing region (a region through which the recording medium passes) of the fixing member with an interval and a contact piece configured to come into contact with a non-passing region (a region arranged outside the passing region) of the fixing member.

In such a fixing device, if the contact piece keeps on coming into contact with a part of the non-passing region of the fixing member, the part of the non-passing region of the fixing member is locally worn out by friction with the contact piece and there is a fear that the fixing member is broken.

SUMMARY

In accordance with an embodiment of the present disclosure, a fixing device includes a fixing member, a pressuring member, a separating member and a reciprocating mechanism. The fixing member is arranged rotatably around a rotation axis. The fixing member includes a passing region and a non-passing region. Through the passing region, a recording medium passes. The non-passing region is arranged outside the passing region. The pressuring member is arranged rotatably and configured to come into pressure contact with the fixing member so as to form a fixing nip. The separating member includes a separating plate and a contact piece. The separating plate is configured to face the passing region with an interval and separate the recording medium passing through the fixing nip from the passing region. The contact piece is configured to come into contact with the non-passing region. The reciprocating mechanism is configured to reciprocate the separating member along a direction of the rotation axis.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
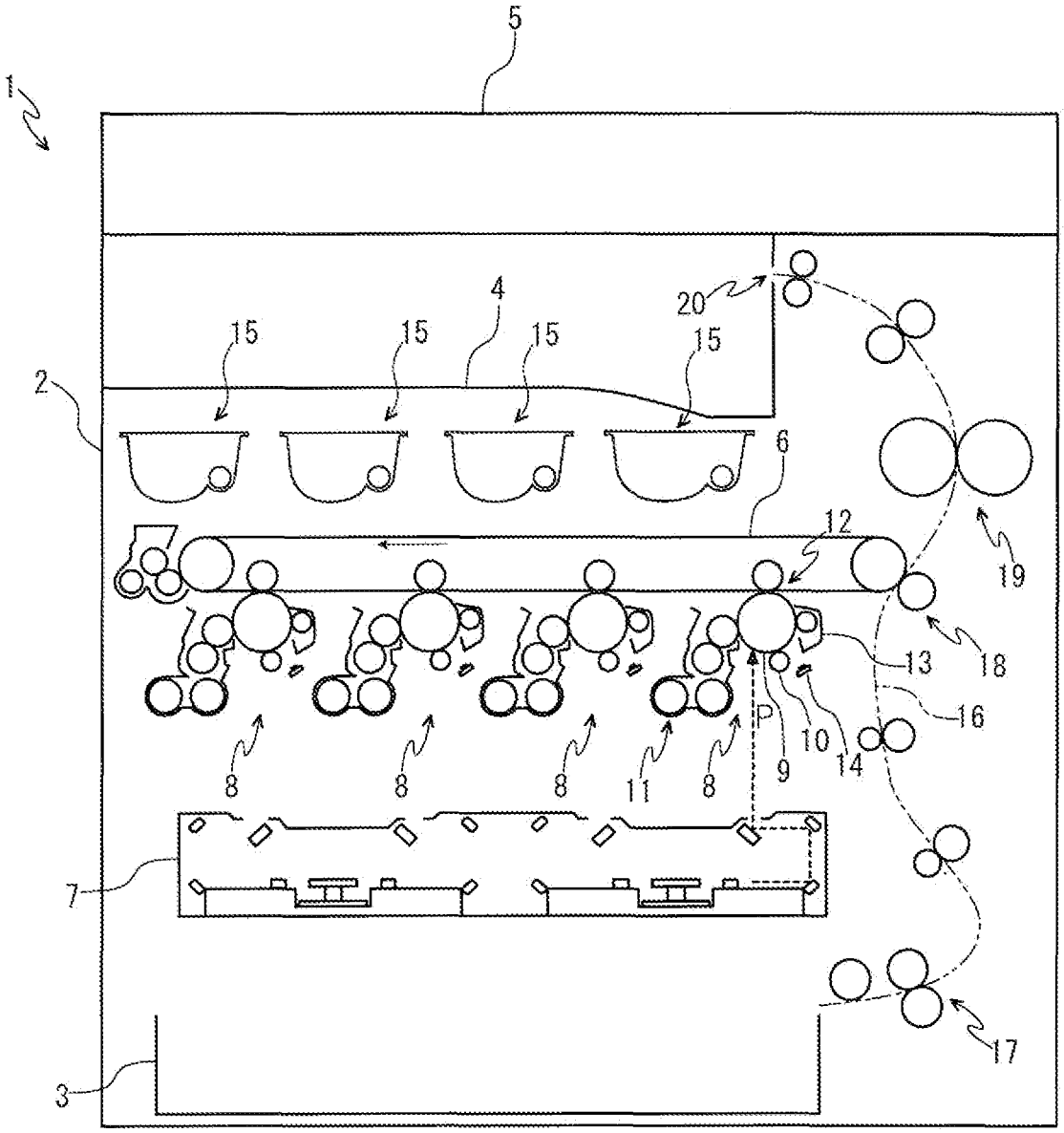
FIG. 1 is a schematic diagram schematically showing a copying machine according to an embodiment of the present disclosure.

First, with reference to FIG. 1, the entire structure of a copying machine 1 (an image forming apparatus) will be described.

The copying machine 1 includes a box-shaped copying machine main body 2. In a lower part of the copying machine main body 2, a sheet feeding cartridge 3 storing sheets (recording mediums) is provided and, in an upper part of the copying machine main body 2, a sheet ejecting tray 4 is provided. In an upper end part of the copying machine main body 2, an image reading device 5 is provided above the sheet ejecting tray 4.

In a center part of the copying machine main body 2, an intermediate transferring belt 6 is provided and, below the intermediate transferring belt 6, an exposure device 7 composed of a laser scanning unit (LSU) is arranged. Under the intermediate transferring belt 6, four image forming units 8 are provided for respective colors (for example, four colors of magenta, cyan, yellow and black) of toners. Hereinafter, one of the four image forming units 8 will be described. In each image forming unit 8, a photosensitive drum 9 is rotatably provided. Around the photosensitive drum 9, a charger 10, a development device 11, a first transferring unit 12, a cleaning device 13 and a static eliminator 14 are arranged in order of a first transferring process. Above the development device 11, four toner containers 15 corresponding to the image forming units 8 are provided for different colors (for example, four colors of magenta, cyan, yellow and black) of toners, respectively.

On one side (the right side in the figure) in the copying machine main body 2, a sheet conveying path 16 extending in the upper and lower directions is provided. At an upper stream end of the conveying path 16, a sheet feeder 17 is provided. At an intermediate stream part of the conveying path 16, a second transferring unit 18 is provided at one end (the right end in the figure) of the intermediate transferring belt 6. At a lower stream part of the conveying path 16, a fixing device 19 is provided. At a lower stream end of the conveying path 16, a sheet ejecting port 20 is provided.

Next, the operation of forming an image by the copying machine 1 having such a configuration will be described. When the power is supplied to the copying machine 1, various parameters are initialized and initial determination, such as temperature determination of the fixing device 19, is carried out. Subsequently, when an image is read by the image reading device 5, the image forming operation is carried out as follows.

First, the surface of the photosensitive drum 9 is electrically charged by the charger 10. Then, the surface of the photosensitive drum 9 is irradiated with a laser (refer to an arrow P) by the exposure device 7, thereby forming an electrostatic latent image on the surface of the photosensitive drum 9. The electrostatic latent image is then developed to a toner image having a correspondent color by the developing device 11 with a toner supplied from the toner container 15. The toner image is first-transferred onto the surface of the intermediate transferring belt 6 in the first transferring unit 12. The above-mentioned operation is repeated in order by the image forming units 8, thereby forming the toner image having full color on the intermediate transferring belt 6. Toner and electric charge remained on the photosensitive drum 9 are eliminated by the cleaning device 13 and static eliminator 14.

On the other hand, a sheet fed from the sheet feeding cartridge 3 by the sheet feeder 17 is conveyed to the second transferring unit 18 in a suitable timing for the above-mentioned image forming operation. Then, in the second transferring unit 18, the toner image having full color on the intermediate transferring belt 6 is second-transferred onto the sheet. The sheet with the second-transferred toner image is conveyed to a lower stream side on the conveying path 16 to enter the fixing device 19, and then, the toner image is fixed on the sheet in the fixing device 19. The sheet with the fixed toner image is ejected from the first sheet ejecting port 20 on the sheet ejecting tray 4.

Next, the fixing device 19 will be described. For ease of description, the front side of FIG. 2 will indicate a front surface side (front side) of the fixing device 19 in the following description. An arrow Fr optionally assigned in each figure indicates the front surface side (front side) of the fixing device 19.

Figure 2:
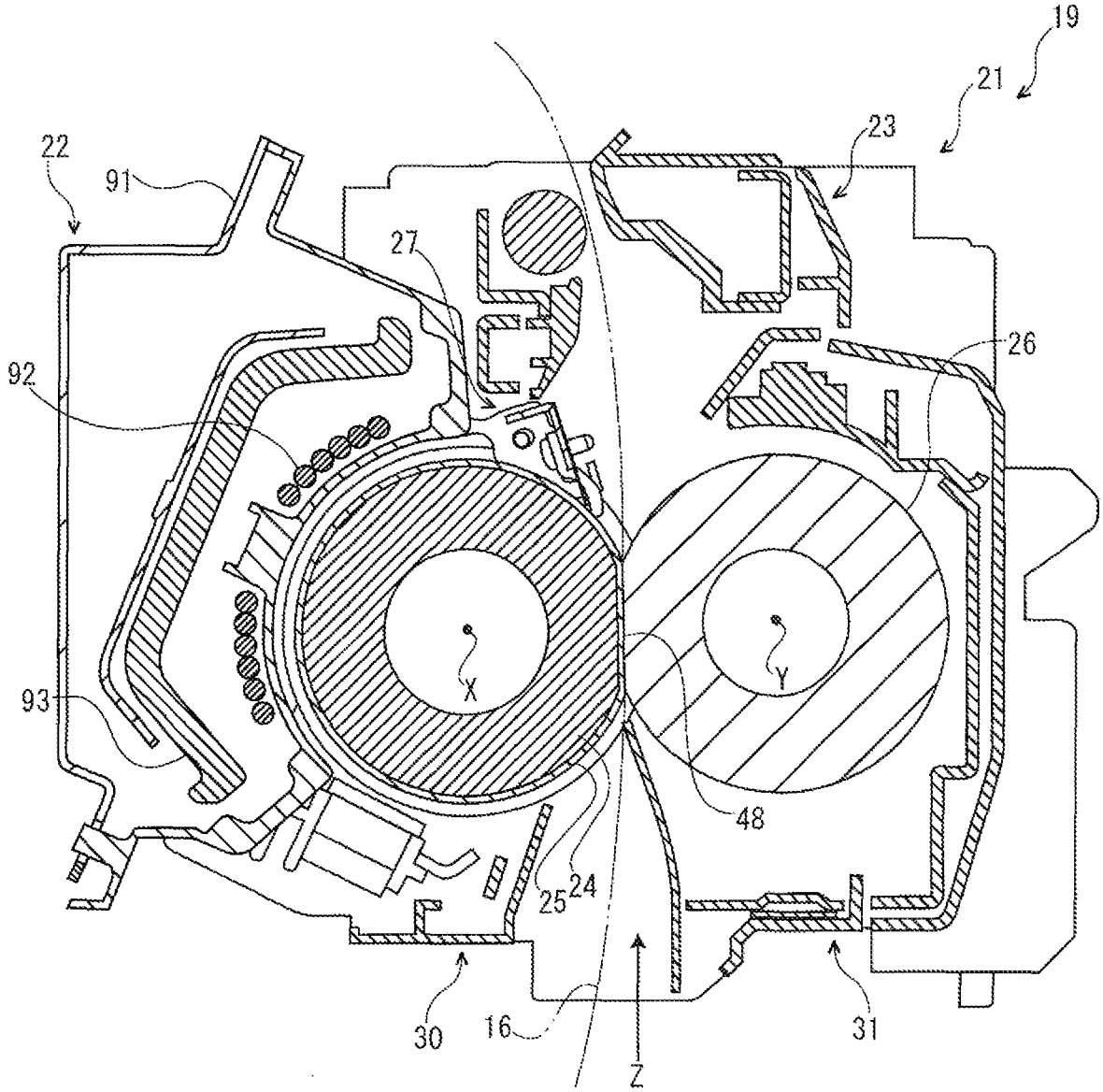
FIG. 2 is a sectional view showing a center part in the front and back directions of a fixing device, in the copying machine according to the embodiment of the present disclosure.

As shown in FIG. 2, the fixing device 19 is provided with a fixing unit 21 and an IH unit 22 provided at the left side of the fixing unit 21.

First, the fixing unit 21 of the fixing device 19 will be described. The fixing unit 21 is attachable/detachable to and from the copying machine main body 2. As shown in FIG. 2, the fixing unit 21 is provided with a fixing frame 23, a fixing roller 24 stored in a left side part of the fixing frame 23, a fixing belt 25 (fixing member) provided around the fixing roller 24, a pressuring roller 26 (pressuring member) stored in a right side part of the fixing frame 23, a separating member 27 provided at an upper right side of the fixing belt 25, and a reciprocating mechanism 28 (not shown in FIG. 2) provided at a front end side of the separating member 27.

Figure 3:
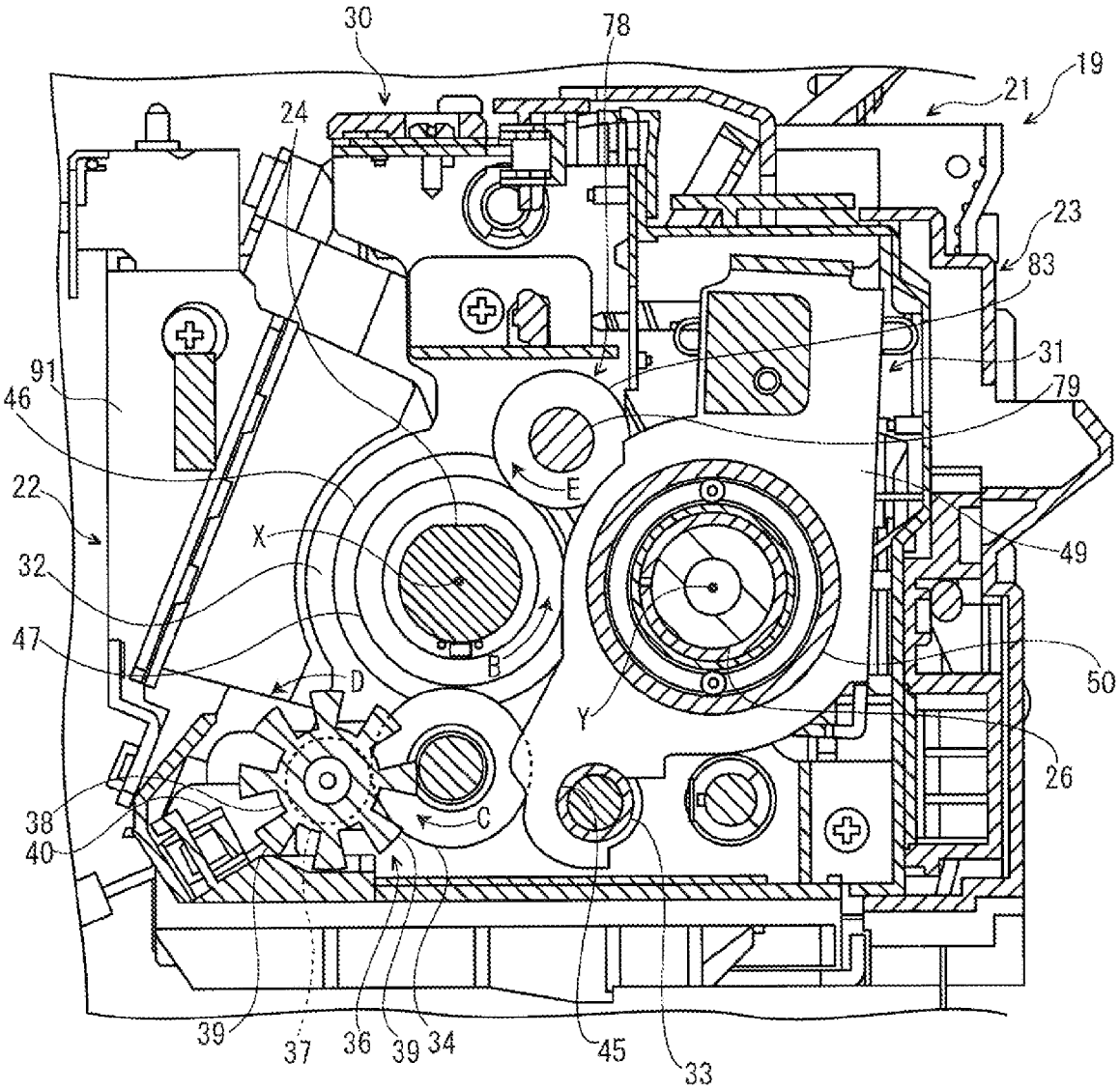
FIG. 3 is a sectional view showing a front end part of the fixing device, in the copying machine according to the embodiment of the present disclosure.

As shown in FIG. 3, the fixing frame 23 is provided with a first supporting part 30, and a second supporting part 31 provided at the right side of the first supporting part 30.

At a lower right part of a front wall part 32 (wall part) and a back wall part (not shown) of the first supporting part 30, a supporting pivot part 33 protrudes. At a lower front side of the front wall part 32 of the first supporting part 30, an idle gear 34 is provided at a left side of the supporting pivot part 33. At the left side of the idle gear 34, a detected member 36 is provided. The detected member 36 is provided with a detecting gear 37 and a pulse plate 38 provided at the front side of the detecting gear 37. The detecting gear 37 is meshed with the idle gear 34. At an outer circumference of the pulse plate 38, a plurality of (eight in this embodiment) detected pieces 39 are formed at intervals in a circumferential direction. At the left side of the detected member 36, a detecting part 40 is provided. The detecting part 40 is a PI sensor (Photo Interrupter Sensor) provided with a light emitting part and a light receiving part.

Figure 4:
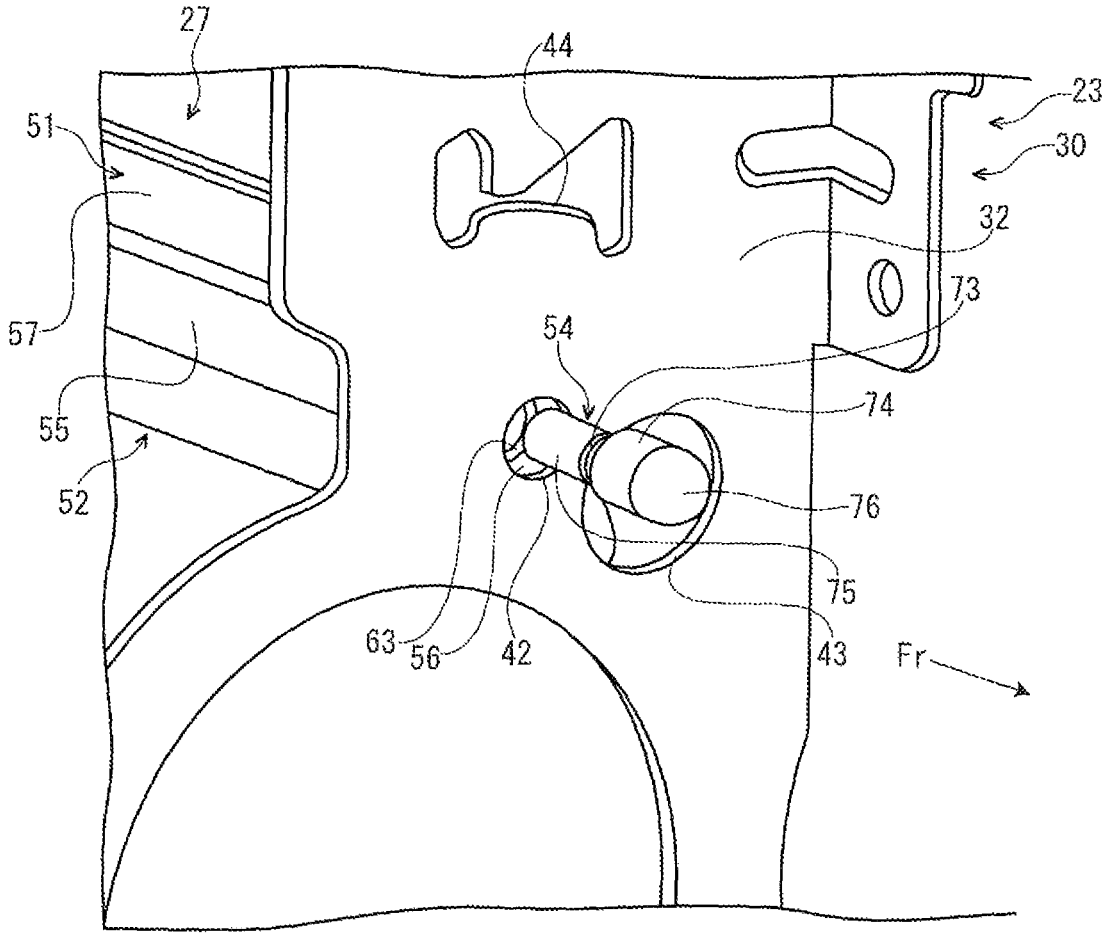
FIG. 4 is a perspective view seen from a left front side and showing a front wall part of a first supporting part and a separating member, in the fixing device of the copying machine according to the embodiment of the present disclosure.

As shown in FIG. 4 and others, at an upper part of the front wall part 32 and the back wall part (not shown) of the first supporting part 30, a circular through hole 42 is formed along a front and back directions. At the upper part of the front wall part 32 of the first supporting part 30, a circular bearing hole 43 is formed at a lower right side of the through hole 42 and along the front and back directions. At the upper part of the front wall part 32 of the first supporting part 30, an attachment hole 44 is formed above the through hole 42 and along the front and back directions.

As shown in FIG. 3, at a lower left part of a front end wall 49 and a back end wall (not shown) of the second supporting part 31, an arc-shaped engaging groove 45 is formed. The engaging groove 45 engages with the supporting pivot part 33 protruding from the front wall part 32 and the back wall part (not shown) of the first supporting part 30. Thus, the second supporting part 31 is supported by the first supporting part 30 rotatably around the supporting pivot part 33.

The fixing roller 24 (refer to FIG. 2 and others) is formed in a cylindrical shape extending in the front and back directions. The fixing roller 24 is composed of a substrate layer of a cylindrical shape and an elastic layer of a cylindrical shape provided around the substrate layer, for example. The substrate layer of the fixing roller 24 is made of metal such as stainless steel or aluminum, for example. The elastic layer of the fixing roller 24 is made of silicon rubber or silicon sponge, for example.

As shown in FIG. 3, the front and back end parts of the fixing roller 24 are attached to the front wall part 32 and the back wall part (not shown) of the first supporting part 30 via a first bearing part 46. Thus, the fixing roller 24 is rotatably supported by the first supporting part 30. The fixing roller 24 is rotatable around a rotation axis X extending in the front and back directions. That is, in this embodiment, the front and back directions is a direction of the rotation axis of the fixing roller 24. At a front end part of the fixing roller 24, a drive gear 47 is fixed.

The fixing belt 25 (refer to FIG. 2 and others) is formed in a cylindrical shape extending in the front and back directions.

The fixing belt 25 is composed of a substrate layer, an elastic layer provided around the substrate layer and a release layer (surface layer) coating the elastic layer, for example. The substrate layer of the fixing belt 25 is made of metal, such as nickel electroforming. The elastic layer of the fixing belt 25 is made of silicon rubber or silicon sponge, for example. The release layer of the fixing belt 25 is made of fluoroethylene resin such as PFA (Perfluoro alkoxy alkane) or PTFE (polytetrafluoroethylene), for example.

The fixing belt 25 is fixed to an outer circumference of the fixing roller 24, and is rotatably supported by the first supporting part 30 via the fixing roller 24. The fixing belt 25 is rotatably provided integrally with the fixing roller 24 around the rotation axis X extending in the front and back directions. That is, in this embodiment, the front and back directions is a direction of a rotation axis of the fixing belt 25.

Figure 5:
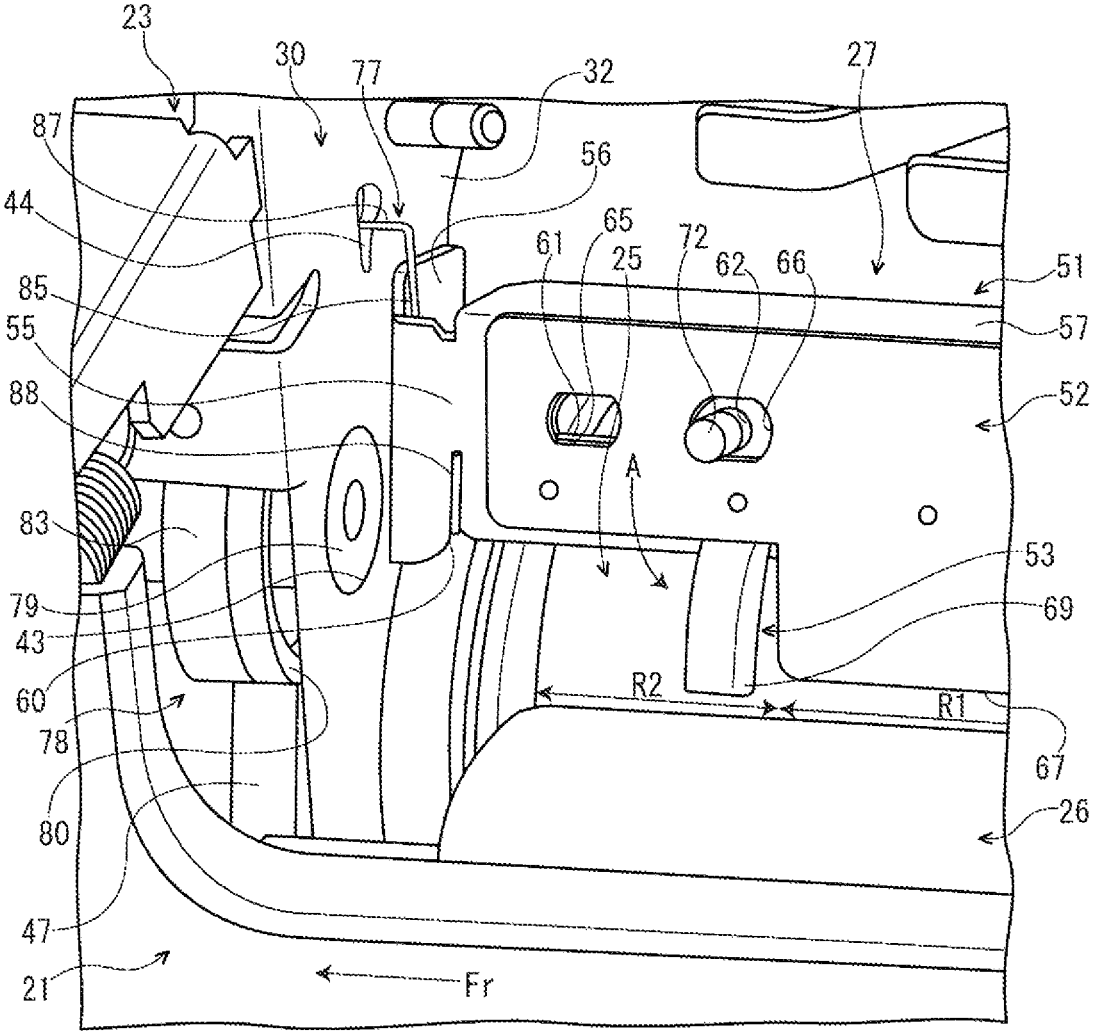
FIG. 5 is a perspective view seen from a right side and showing a front end part of a fixing belt and its periphery, in the fixing device of the copying machine according to the embodiment of the present disclosure.

As shown in FIG. 5 and others, at the outer circumference of the fixing belt 25, a passing region R1 through which a sheet (e.g. an A3 size sheet) passes and non-passing regions R2 through which the sheet does not pass are formed. The non-passing regions R2 are formed at the front and back sides of the passing region R1 (outside the passing region R1). FIG. 5 shows a front part of the passing region R1 and the front-side non-passing region R2.

The pressuring roller 26 (refer to FIG. 2 and others) is formed in a cylindrical shape extending in the front and back directions. The pressuring roller 26 comes into pressure-contact with the fixing belt 25 so as to form a fixing nip 48 between the fixing belt 25 and the pressuring roller 26. The pressuring roller 26 is composed of a substrate layer, an elastic layer provided around the substrate layer and a release layer (surface layer) coating the elastic layer, for example. The substrate layer of the pressuring roller 26 is made of metal such as stainless steel or aluminum, for example. The elastic layer of the pressuring roller 26 is made of silicon rubber or silicon sponge, for example. The release layer of the pressuring roller 26 is made of fluoroethylene resin such as PFA or PTFE, for example.

As shown in FIG. 3, the front and back end parts of the pressuring roller 26 are rotatably attached to a front end wall 49 and a back end wall (not shown) of the second supporting part 31 via a second bearing part 50. Thus, the pressuring roller 26 is rotatably supported by the second supporting part 31. The pressuring roller 26 is rotatably provided around a rotation axis Y which extends in the front and back directions. That is, in this embodiment, the front and back directions is a direction of a rotation axis of the pressuring roller 26.

Figure 6:
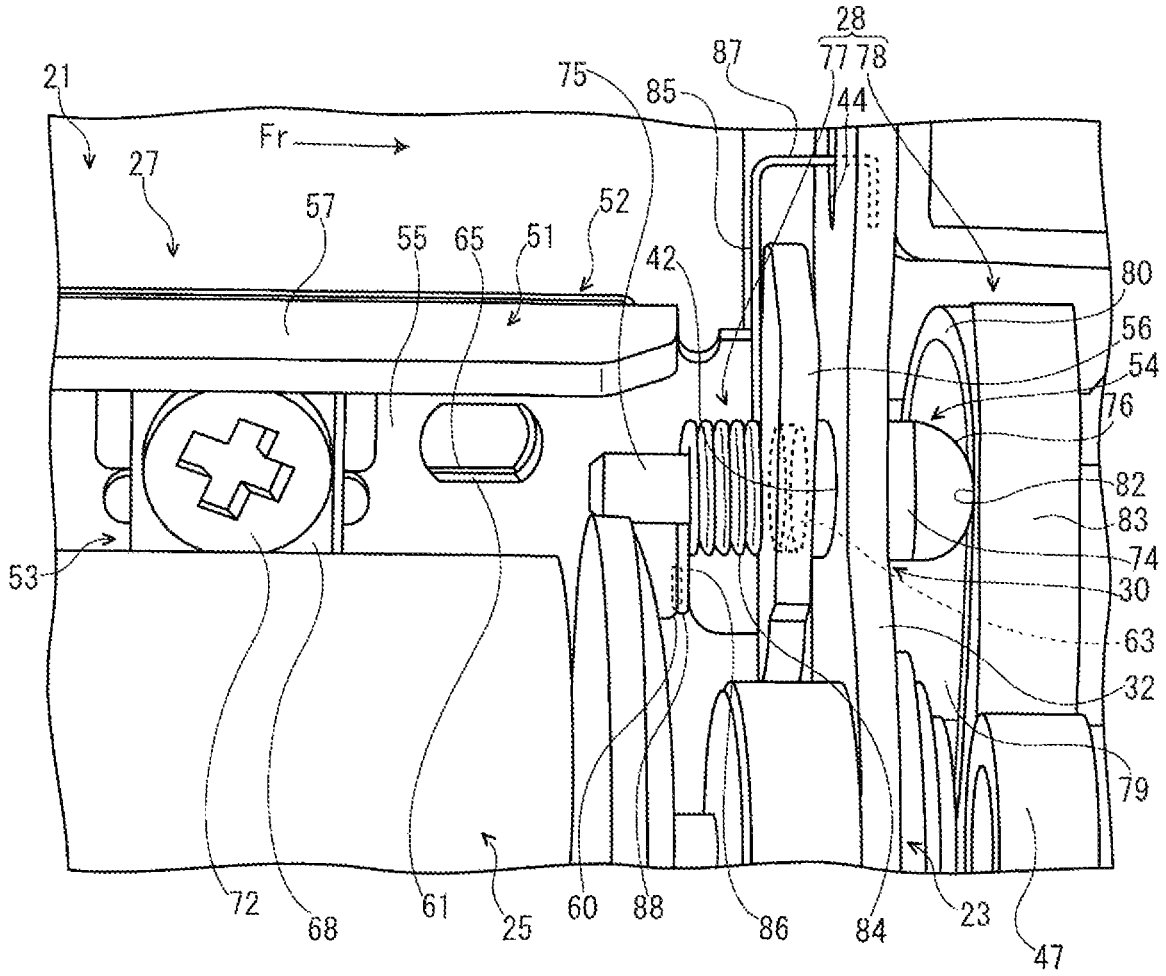
FIG. 6 is a perspective view seen from a left side and showing a situation in which the separating member is moved to a front side, in the fixing device of the copying machine according to the embodiment of the present disclosure.

As shown in FIG. 2, the separating member 27 is arranged at the downstream side from the fixing belt 25 in a sheet conveying direction (refer to an arrow Z in FIG. 2). The separating member 27 is formed in a long shape extending in the front and back directions. FIGS. 5 and 6 show a front-side component of a pair of front and back components of the separating member 27.

As shown in FIGS. 5 and 6 and others, the separating member 27 is provided with a supporting plate 51, a separating plate 52 supported by a right side part of the supporting plate 51, contact pieces 53 fixed to front and back end parts of the supporting plate 51, and pressed pieces 54 fixed to the front and back end parts of the supporting plate 51.

The supporting plate 51 of the separating member 27 is formed in a shape extending in the front and back directions. The supporting plate 51 is made of sheet metal, for example. The supporting plate 51 is provided with a main body part 55, side plate parts 56 bent toward the lower left side from front and back end parts of the main body part 55 and a bent part 57 bent toward the lower left side from an upper end part of the main body part 55.

As shown in FIG. 5 and others, at a front end part of a lower end part of the main body part 55 of the supporting plate 51, an engaging concave part 60 is formed upwardly. At the front end part and the back end part of the main body part 55 of the supporting plate 51, a first positioning hole 61 is formed. At the front end part and the back end part of the main body part 55 of the supporting plate 51, a first insertion hole 62 is formed inside the first positioning hole 61 in the front and back directions.

Figure 7:
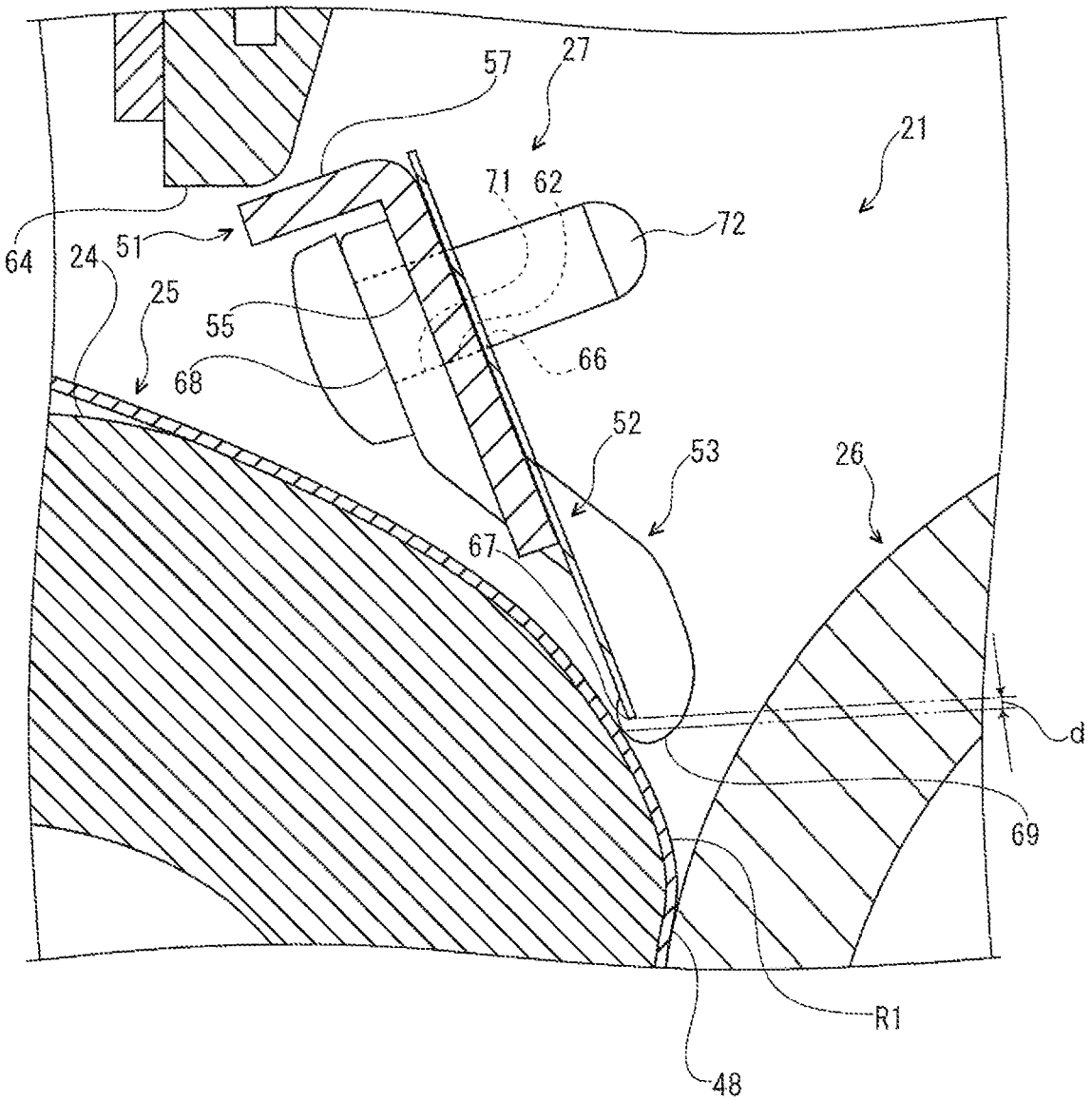
FIG. 7 is a sectional view showing the separating member and its periphery, in the fixing device of the copying machine according to the embodiment of the present disclosure.

As shown in FIG. 6 and others, in each side plate part 56 of the supporting plate 51, a circular screw hole 63 is formed along the front and back directions. As shown in FIG. 7 and others, at an upper side of the bent part 57 of the supporting plate 51, a restricting part 64 is formed. The restricting part 64 is formed on the fixing frame 23, for example. The restricting part 64 faces the bent part 57 of the supporting plate 51 at a slight gap.

As shown in FIG. 5 and others, the separating plate 52 of the separating member 27 is formed in a long flat shape extending in the front and back directions. The separating plate 52 is fixed to a right side surface of the main body part 55 of the supporting plate 51 by a fixing method such as welding. The separating plate 52 is made of sheet metal, for example. At the front end part and the back end part of the separating plate 52, a second positioning hole 65 is formed at a position corresponding to the first positioning hole 61 of the main body part 55 of the supporting plate 51. Inside the second positioning hole 65 in the front and back directions, a second insertion hole 66 is formed at a position corresponding to the first insertion hole 62 of the main body part 55 of the supporting plate 51. As shown in FIG. 7, a distal end part 67 (lower end part) of the separating plate 52 faces the passing region R1 of the fixing belt 25 at an interval d.

The contact piece 53 of the separating member 27 is provided with a fixed part 68 and a contact part 69 extending in a lower right direction from the lower end part of the fixed part 68. To the fixed part 68, a third insertion hole 71 is formed. Further, a screw 72 which penetrates through the first insertion hole 62 of the main body part 55 of the supporting plate 51, the second insertion hole 66 of the separating plate 52 and the third insertion hole 71 of the fixed part 68 fixes the contact piece 53 to the supporting plate 51. As shown in FIG. 5 and others, the contact part 69 comes into contact with the non-passing region R2 of the fixing belt 25.

Figure 8:
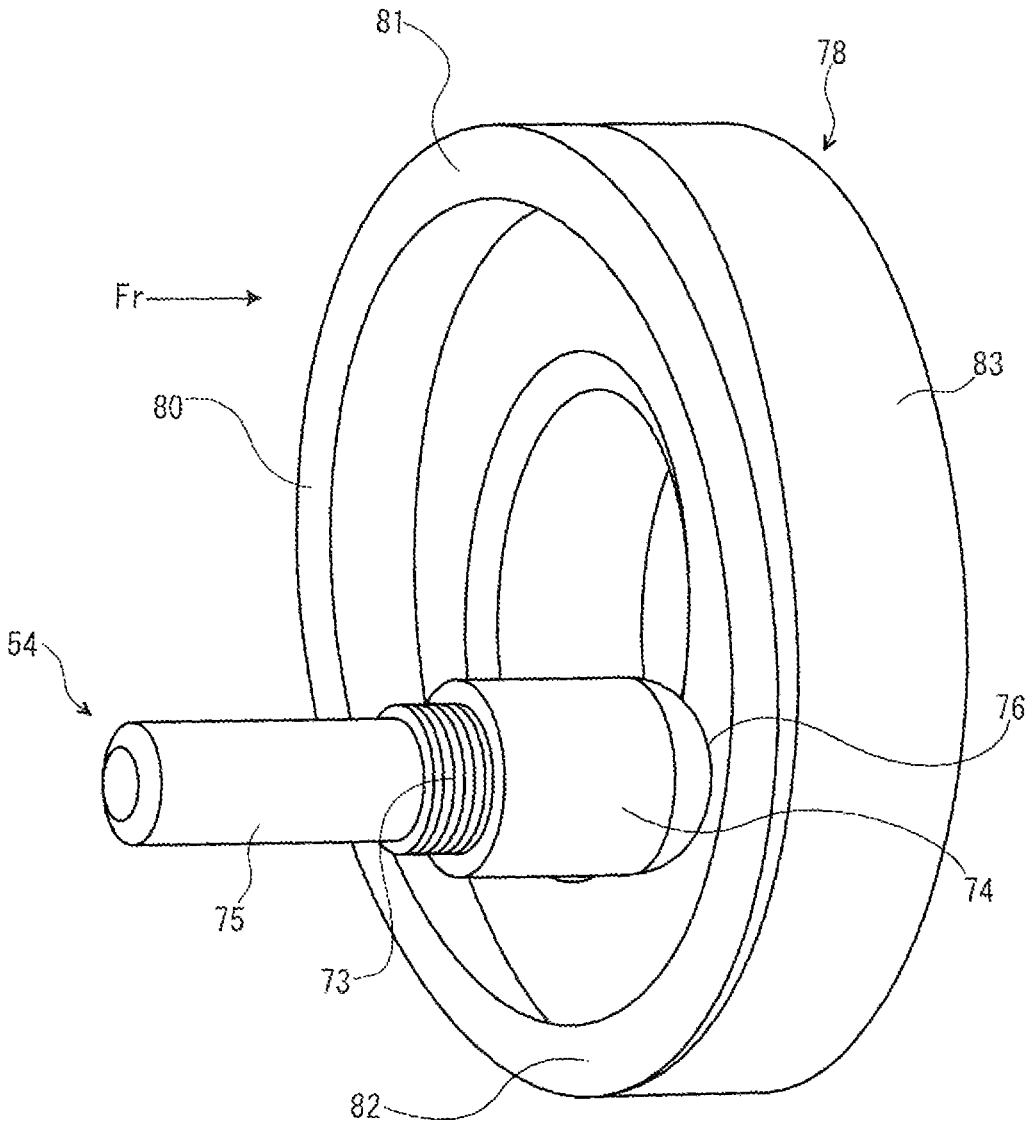
FIG. 8 is a perspective view seen from a left side and showing a pressed piece and a pressing member, in the fixing device of the copying machine according to the embodiment of the present disclosure.

As shown in FIG. 8 and others, the front-side pressed piece 54 of the separating member 27 extends along the front and back directions. The front-side pressed piece 54 of the separating member 27 is provided with a screw part 73, a pressed part 74 formed at the front side (the first side in the front and back directions) of the screw part 73 and an attachment part 75 formed at the back side (the second side in the front and back directions) of the screw part 73.

The screw part 73 of the front-side pressed piece 54 is screwed with a screw hole 63 (refer to FIG. 6) formed in the front-side side plate part 56 of the supporting plate 51 of the separating member 27. Thus, the front-side pressed piece 54 is fixed to the supporting plate 51 of the separating member 27.

The pressed part 74 of the front-side pressed piece 54 extends toward the front side from the screw part 73 along the front and back directions. An outer diameter of the pressed part 74 is larger than an outer diameter of the screw part 73. As shown in FIG. 6 and others, the pressed part 74 is inserted through the through hole 42 formed in the front wall part 32 of the first supporting part 30 of the fixing frame 23. Thus, the separating member 27 is supported by the fixing frame 23 with a state of being rotatable around the pressed piece 54. The front end part of the pressed part 74 protrudes toward the front side compared to the front wall part 32 of the first supporting part 30 of the fixing frame 23. At the front end part of the pressed part 74, a curved part 76 curved in a semispherical shape toward the front side is formed.

As shown in FIG. 8 and others, the attachment part 75 of the front-side pressed piece 54 extends toward the back side from the screw part 73 along the front and back directions. The outer diameter of the attachment part 75 is smaller than the outer diameter of the screw part 73.

The back-side pressed piece (not shown) and the front-side pressed piece 54 form a symmetrical shape in the front and back directions. The back-side pressed piece will not be described.

As shown in FIG. 6 and others, the reciprocating mechanism 28 is provided with a biasing member 77 and a pressing member 78 formed at the front side of the biasing member 77.

The biasing member 77 is composed of a helical coil spring made of one wire rod. The biasing member 77 is provided with a winding part 84, a first arm part 85 extending upward from the winding part 84 and a second arm part 86 extending downward from the winding part 84.

The winding part 84 of the biasing member 77 is attached to the outer circumference of the attachment part 75 formed in the front-side pressed piece 54 of the separating member 27. At the upper end of the first arm part 85 of the biasing member 77, a first hook part 87 is formed. The first hook part 87 is inserted through the attachment hole 44 formed in the front wall part 32 of the first supporting part 30 of the fixing frame 23, and comes into contact with the front surface of the front wall part 32. At the lower end of the second arm part 86 of the biasing member 77, the second hook part 88 is formed. The second hook part 88 is engaged with the engaging concave part 60 formed in the main body part 55 of the supporting plate 51 of the separating member 27.

According to the above configuration, the biasing member 77 biases the separating member 27 toward the front side (the first side in the front and back directions), and biases the separating member 27 in a rotating direction (refer to an arrow A in FIG. 5) in which the contact part 69 of the contact piece 53 is pressed to the non-passing region R2 of the fixing belt 25.

As shown in FIG. 6 and others, the pressing member 78 is positioned at the front side (the first side in the front and back directions) of the separating member 27. Between the separating member 27 and the pressing member 78, the front wall part 32 of the first supporting part 30 of the fixing frame 23 is disposed.

Figure 9:
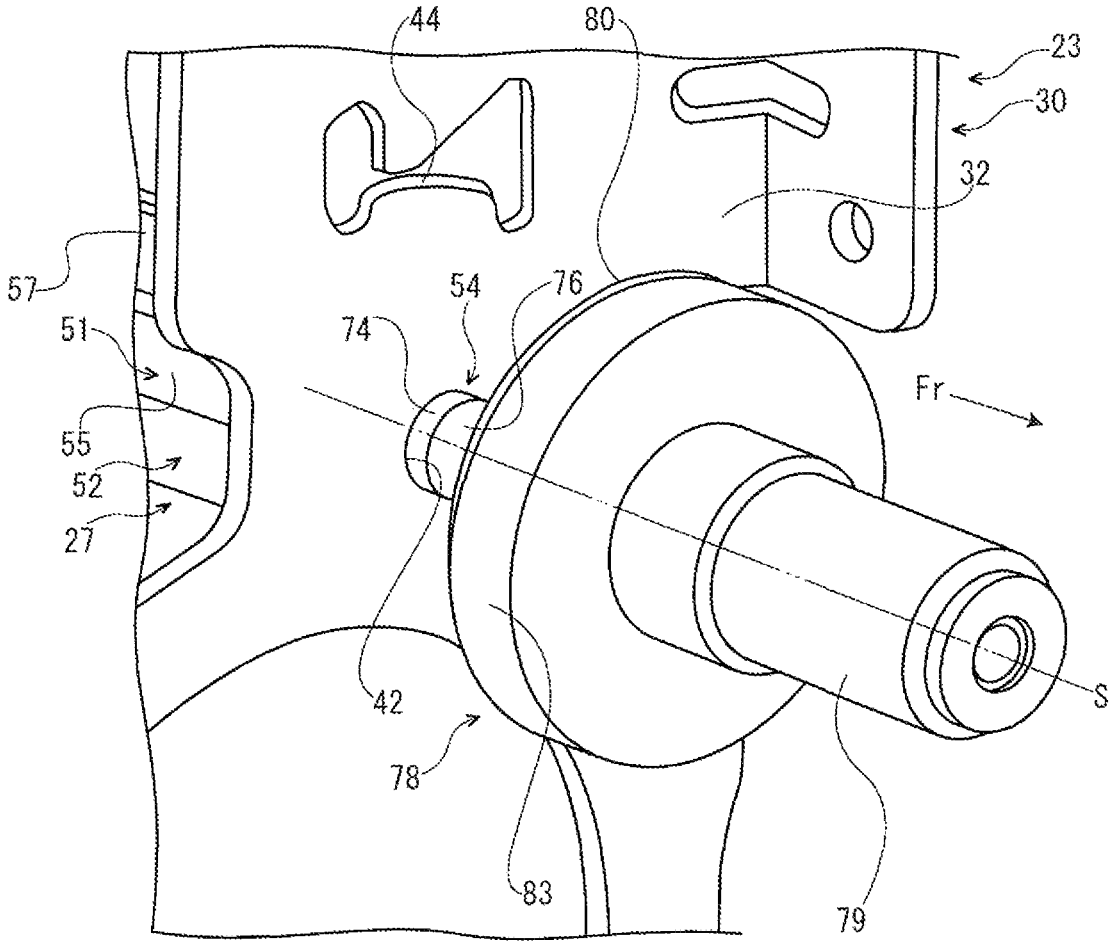
FIG. 9 is a perspective view seen from a left front side and showing the front wall part of the first supporting part, the separating member, the pressing member and an axis member in the fixing device of the copying machine according to the embodiment of the present disclosure.

As shown in FIG. 9 and others, the pressing member 78 is attached to the outer circumference of an axis member 79, and is formed rotatably around an axis center S of the axis member 79. In addition, the pressing member 78 may rotate integrally with the axis member 79 or may rotate with respect to the axis member 79. As shown in FIG. 5, the back end part of the axis member 79 is attached to the bearing hole 43 formed in the front wall part 32 of the first supporting part 30 of the fixing frame 23.

As shown in FIG. 8 and others, in the back surface (a surface at the second side in the front and back directions) of the pressing member 78, a cam part 80 is formed. The cam part 80 is formed in an annular shape, and the position of the cam part 80 in the front and back directions is continuously varied along the circumferential direction. A portion of the cam part 80 which protrudes toward the backmost side will be referred to as a protruding part 81 of the cam part 80, and a portion of the cam part 80 which retreats toward the frontmost side will be referred to as a retreating part 82 of the cam part 80. The left side part (the right side part in FIG. 8) of the cam part 80 comes into contact with the curved part 76 of the pressed part 74 formed at the front-side pressed piece 54 of the separating member 27.

At an outer circumference part of the pressing member 78, a driven gear 83 is formed. As shown in FIG. 3, the driven gear 83 is meshed with the drive gear 47 fixed to the front end part of the fixing roller 24.

Next, the IH unit 22 (refer to FIG. 2) of the fixing device 19 will be described. The IH unit 22 is fixed to the copying machine main body 2. The IH unit 22 is provided with a case member 91, an IH coil 92 (a heating source) stored in the case member 91 and formed in an arc shape around the outer circumference of the fixing belt 25 and an arcuate core 93 stored in the case member 91 and formed around the outer circumference of the IH coil 92.

In the fixing device 19 having the above-mentioned configuration, when the toner image is fixed to a sheet, a driving source (not shown) is driven to rotate the pressuring roller 26. When the pressuring roller 26 is rotated, the fixing belt 25 which comes into pressure-contact with the pressuring roller 26 is rotated in the direction reverse to the pressuring roller 26. Furthermore, when the toner image is fixed on a sheet, the IH coil 92 performs eddy-current heating on the fixing belt 25. Under this state, when the sheet to which an unfixed toner image is transferred passes through the fixing nip 48, the sheet and the toner image are heated and pressured to fix the toner image on the sheet. The sheet passed through the fixing nip 48 is separated from the passing region R1 of the fixing belt 25 by the separating plate 52 of the separating member 27.

Further, when the fixing belt 25 is rotated as mentioned above, the fixing roller 24 fixed to the fixing belt 25 is also rotated and, as indicated by an arrow B in FIG. 3, the drive gear 47 fixed to the front end part of the fixing roller 24 is also rotated. When the drive gear 47 is rotated, the idle gear 34 meshed with the drive gear 47 is rotated in the direction reverse to the drive gear 47 as indicated by an arrow C in FIG. 3. When the idle gear 34 is rotated, the detected member 36 which meshes the detecting gear 37 with the idle gear 34 is rotated in the direction reverse to the idle gear 34 as indicated by an arrow D in FIG. 3. When the detected member 36 is rotated, a plurality of detected pieces 39 formed in the pulse plate 38 of the detected member 36 pass between the light emitting part and the light receiving part of the detecting part 40. Thus, the detecting part 40 detects rotation of the detected member 36. By applying such a configuration, it is possible to reliably determine whether or not the fixing belt 25 is rotating.

By the way, in the fixing device 19 according to this embodiment, the contact part 69 of the contact piece 53 of the separating member 27 comes into contact with the non-passing region R2 of the fixing belt 25 with a certain load at all times upon warm-up and a printing operation. When such a configuration is applied, if the contact part 69 of the contact piece 53 keeps on coming into contact with a part of the non-passing region R2 of the fixing belt 25, there is a fear that the release layer, the elastic layer and the substrate layer, which are part of the non-passing region R2 of the fixing belt 25, are sequentially worn out and the fixing belt 25 is broken. Then, in this embodiment, the fixing belt 25 is prevented from being broken as follows.

When the drive gear 47 is rotated with the rotation of the fixing belt 25 as mentioned above, the pressing member 78 which meshes the driven gear 83 with the drive gear 47 rotates in the direction reverse to the drive gear 47 as indicated by an arrow E in FIG. 3. When the pressing member 78 is at a given rotating position, the retreating part 82 of the cam part 80 of the pressing member 78 comes into contact with the pressed part 74 of the front-side pressed piece 54 of the separating member as shown in FIG. 6. In this case, the separating member 27 is moved to the front side by the biasing force of the biasing member 7.

Figure 10:
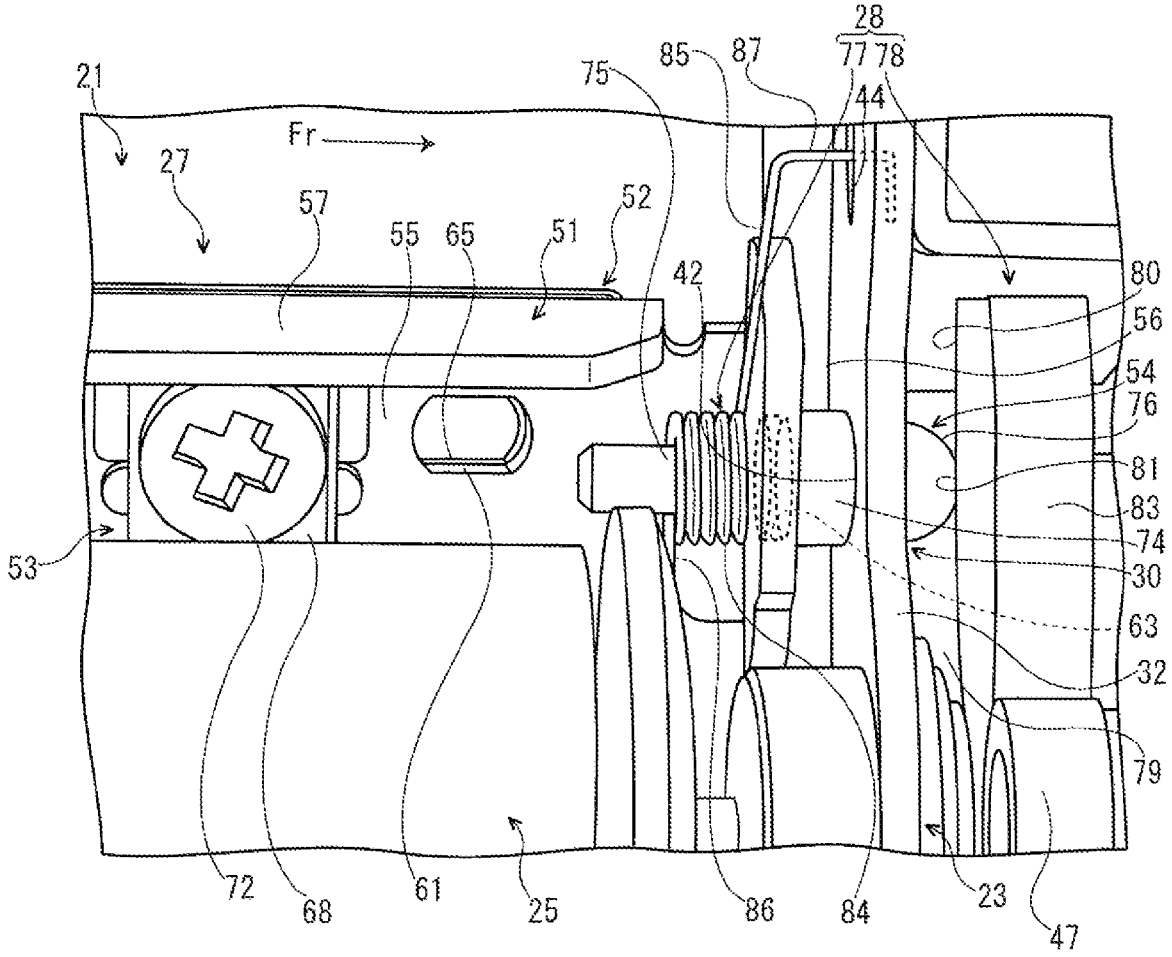
FIG. 10 is a perspective view seen from a left side and showing a situation in which the separating member is moved to a rear side, in the fixing device of the copying machine according to the embodiment of the present disclosure.

By contrast with this, when the pressing member 78 is rotated 180 degrees from the above rotating position, the protruding part 81 of the cam part 80 of the pressing member 78 comes into contact with the pressed part 74 of the front-side pressed piece 54 of the separating member 27 as shown in FIG. 10. Thus, against the biasing force of the biasing member 77, the cam part 80 of the pressing member 78 presses the pressed part 74 of the front-side pressed piece 54 of the separating member 27 toward the back side (the second side in the front and back directions), and the separating member 27 moves to the back side.

On the other hand, when the pressing member 78 is further rotated 180 degrees, the retreating part 82 of the cam part 80 of the pressing member 78 comes into contact again with the pressed part 74 of the front-side pressed piece 54 of the separating member 27 as shown in FIG. 6. Thus, the separating member 27 is moved toward the front side by the biasing force of the biasing member 77. The above operation is repeated, so that the separating member 27 continuously reciprocates along the front and back directions.

In this embodiment, the reciprocating mechanism 28 continuously reciprocates the separating member 27 along the front and back directions. Consequently, it is possible to displace a contact position of the contact part 69 of the contact piece 53 to the non-passing region R2 of the fixing belt 25 in the front and back directions. Thus, it is possible to prevent a part of the non-passing region R2 of the fixing belt 25 from being worn out by the friction with the contact piece 53 of the contact part 69, and prolong a lifetime of the fixing belt 25. Further, the separating plate 52 of the separating member 27 reciprocates along the front and back directions, so that it is possible to prevent unfixed toner from being locally deposited at a part of the separating plate 52 and prevent occurrence of JAM (jamming of sheets).

Furthermore, the separating plate 52 of the separating member 27 faces the passing region R1 of the fixing belt 25 with the interval d. When such a configuration is applied, to stably separate sheets from the passing region R1 of the fixing belt 25, it is important to stabilize a positional relationship between the separating plate 52 of the separating member 27 and the passing region R1 of the fixing belt 25, and precisely maintain the interval d between the separating plate 52 of the separating member 27 and the passing region R1 of the fixing belt 25. In this regard, in this embodiment, the contact piece 53 of the separating member 27 comes into contact with the non-passing region R2 of the fixing belt 25. Consequently, it is possible to stabilize the positional relationship between the separating plate 52 of the separating member 27 and the passing region R1 of the fixing belt 25, and precisely maintain the interval d between the separating plate 52 of the separating member 27 and the passing region R1 of the fixing belt 25.

Further, the reciprocating mechanism 28 is provided with the biasing member 77 which biases the separating member 27 toward the front side (the first side in the front and back directions), and the pressing member 78 which presses the separating member 27 toward the back side (the second side in the front and back directions) against the biasing force of the biasing member 77. By applying such a configuration, it is possible to reciprocate the separating member 27 along the front and back directions by using a simple configuration.

Further, in the back surface (the surface at the second side in the front and back directions) of the pressing member 78, the cam part 80 which presses the separating member 27 with rotation of the pressing member 78 is formed. By applying such a configuration, it is possible to press the separating member 27 by using a simple configuration.

Further, at the outer circumference part of the pressing member 78, the driven gear 83 meshed with the drive gear 47 which is rotated with rotation of the fixing belt 25 is formed. By applying such a configuration, it is possible to rotate the pressing member 78 with rotation of the fixing belt 25. Consequently, a dedicated driving source for rotating the pressing member 78 does not need to be provided, so that it is possible to reduce manufacturing cost.

Further, the cam part 80 is formed in an annular shape and the position of the cam part 80 in the front and back directions is continuously varied along the circumferential direction. By applying such a configuration, it is possible to prevent a speed of reciprocating movement of the separating member 27 from rapidly changing.

Further, the separating member 27 is provided with the supporting plate 51 to which the separating plate 52 and the contact piece 53 are fixed, and the front-side pressed piece 54 which is fixed to the supporting plate 51 and is pressed by the pressing member 78. By applying such a configuration, the pressing member 78 can reliably press the separating member 27.

The front-side pressed piece 54 of the separating member 27 is provided with the screw part 73 screwed with the screw hole 63 formed in the supporting plate 51 of the separating member 27, the pressed part 74 formed at the front side (the first side in the front and back directions) of the screw part 73 and pressed by the pressing member 78, and the attachment part 75 formed at the back side (the second side in the front and back directions) of the screw part 73 and attached with the biasing member 77. By applying such a configuration, it is possible to easily and reliably fix the front-side pressed piece 54 to the supporting plate 51. Further, compared to a case where an attachment member of the biasing member 77 and the front-side pressed piece 54 are separately formed, it is possible to reduce the number of parts.

Furthermore, the pressed part 74 of each pressed piece 54 of the separating member 27 is inserted through the through hole 42 formed in the front wall part 32 and the back wall part (not shown) of the first supporting part 30 of the fixing frame 23, so that the separating member 27 is supported by the fixing frame 23 with a state of being rotatable around each pressed piece 54. By applying such a configuration, it is possible to use each pressed piece 54 as a supporting pivot for rotation of the separating member 27, and reduce the number of parts compared to a case where the supporting pivot for rotation of the separating member 27 and each pressed piece 54 are separately formed.

In addition, when the separating member 27 is made rotatable as mentioned above and particularly when an operation of printing sheets of a high coverage rate is performed, there is a fear that the separating plate 52 of the separating member 27 is lifted up by sheets. When the separating plate 52 is lifted up by sheets as mentioned above, there is a fear that sheets enter a space between the separating plate 52 and the passing region R1 of the fixing belt 25, and therefore JAM (jamming of sheets) is caused.

However, in this embodiment, as shown in FIG. 7, the restricting part 64 restricts a rotating range of the separating member 27. Consequently, it is possible to prevent sheets from entering a space between the separating plate 52 and the passing region R1 of the fixing belt 25 and causing JAM (jamming of sheets).

Further, the biasing member 77 also functions as a member which biases the separating member 27 in the rotating direction in which the contact part 69 of the contact piece 53 is pressed to the non-passing region R2 of the fixing belt 25. By applying such a configuration, it is possible to reduce the number of parts compared to a case where a member which biases the separating member 27 toward the front side (the first side in the front and back directions) and a member which presses the contact part 69 of the contact piece 53 to the non-passing region R2 of the fixing belt 25 are separately formed.

Further, in this embodiment, the IH coil 92 is used as a heating source, so that it is possible to directly perform eddy-current heating on the substrate layer of the fixing belt 25. Consequently, it is possible to increase a heating speed of the fixing belt 25, and shorten a warm-up time.

In this embodiment, a case where a helical coil spring is used for the biasing member 77 was described. However, springs such as coil springs and leaf springs other than helical coil springs may be used for the biasing member 77 in another embodiment. Further, parts such as rubber members other than springs may be used for the biasing member 77.

In the embodiment, a case of using the IH coil 92 as the heat source was described. In another embodiment, another heater, such as a halogen heater or ceramic heater, may be used as the heat source.

In the embodiment, a case of using the fixing belt 25 as the fixing member was described. In another embodiment, a fixing roller may be used as the fixing member.

The embodiment was described in a case of applying the configuration of the present disclosure to the copying machine 1. However, in another embodiment, the configuration of the disclosure may be applied to another image forming apparatus, such as a printer, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing member arranged rotatably around a rotation axis and including a passing region through which a recording medium passes and a non-passing region arranged outside the passing region;

a pressuring member arranged rotatably and configured to come into pressure contact with the fixing member so as to form a fixing nip;

a separating member including a separating plate configured to face the passing region with an interval and separate the recording medium passing through the fixing nip from the passing region and a contact piece configured to come into contact with the non-passing region; and a reciprocating mechanism configured to reciprocate the separating member along a direction of the rotation axis, wherein the reciprocating mechanism includes:

a biasing member configured to bias the separating member to a first side in the direction of the rotation axis; and a pressing member configured to press the separating member to a second side in the direction of the rotation axis against a biasing force of the biasing member, wherein the pressing member is located at the first side in the direction of the rotation axis of the separating member and arranged rotatably, a cam part configured to press the separating member with the rotation of the pressing member is arranged at a face of the second side in the direction of the rotation axis of the pressing member, the fixing device further comprising a drive gear configured to rotate with the rotation of the fixing member, wherein a driven gear configured to be meshed with the drive gear is arranged at an outer circumference part of the pressing member, and the fixing device further comprising:

a detected member configured to rotate with the rotation of the drive gear; and a detecting part configured to detect the rotation of the detected member.

2. The fixing device according to claim 1, wherein the cam part is formed in an annular shape and the position of the cam part in the direction of the rotation axis is continuously varied along a circumference direction of the cam part.

3. The fixing device according to claim 1, wherein the separating member further includes:

a supporting plate to which the separating plate and the contact piece are fixed; and a pressed piece configured to be fixed to the supporting plate and pressed by the pressing member.

4. The fixing device according to claim 1, wherein the biasing member biases the separating member in one direction so that the contact piece is pressed to the non-passing region.

5. The fixing device according to claim 1, wherein the fixing member is a fixing belt provided around a fixing roller arranged rotatably.

6. The fixing device according to claim 5, further comprising an IH coil provided along an outer circumference of the fixing belt and configured to heat the fixing belt.

7. An image forming apparatus comprising:

the fixing device according to claim 1.

8. A fixing device comprising:

a fixing member arranged rotatably around a rotation axis and including a passing region through which a recording medium passes and a non-passing region arranged outside the passing region;

a pressuring member arranged rotatably and configured to come into pressure contact with the fixing member so as to form a fixing nip;

a separating member including a separating plate configured to face the passing region with an interval and separate the recording medium passing through the fixing nip from the passing region and a contact piece configured to come into contact with the non-passing region; and a reciprocating mechanism configured to reciprocate the separating member along a direction of the rotation axis, wherein the reciprocating mechanism includes:

a biasing member configured to bias the separating member to a first side in the direction of the rotation axis; and a pressing member configured to press the separating member to a second side in the direction of the rotation axis against a biasing force of the biasing member, wherein the separating member further includes:

a supporting plate to which the separating plate and the contact piece are fixed; and a pressed piece configured to be fixed to the supporting plate and pressed by the pressing member, and wherein the supporting plate has a screw hole formed along the direction of the rotation axis, the pressed piece includes:

a screw part configured to be screwed with the screw hole;

a pressed part configured to be pressed by the pressing member and arranged at the first side in the direction of the rotation axis of the screw part; and an attachment part to which the biasing member is attached, the attachment part arranged at the second side in the direction of the rotation axis of the screw part.

9. A fixing device comprising:

a fixing member arranged rotatably around a rotation axis and including a passing region through which a recording medium passes and a non-passing region arranged outside the passing region;

a pressuring member arranged rotatably and configured to come into pressure contact with the fixing member so as to form a fixing nip;

a separating member including a separating plate configured to face the passing region with an interval and separate the recording medium passing through the fixing nip from the passing region and a contact piece configured to come into contact with the non-passing region; and a reciprocating mechanism configured to reciprocate the separating member along a direction of the rotation axis, wherein the reciprocating mechanism includes:

a biasing member configured to bias the separating member to a first side in the direction of the rotation axis; and a pressing member configured to press the separating member to a second side in the direction of the rotation axis against a biasing force of the biasing member, wherein the separating member further includes:

a supporting plate to which the separating plate and the contact piece are fixed; and a pressed piece configured to be fixed to the supporting plate and pressed by the pressing member, and the fixing device further comprising a fixing frame configured to rotatably support the fixing member and the pressuring member, wherein the fixing frame includes a wall part disposed between the separating member and the pressing member, the wall part having a through hole formed along the direction of the rotation axis, the pressed piece is inserted through the through hole so that the separating member is supported by the fixing frame with a state of being rotatable around the pressed piece.

* * * * *